US009705221B2

(12) United States Patent
Tadokoro

(10) Patent No.: US 9,705,221 B2
(45) Date of Patent: Jul. 11, 2017

(54) ELECTRONIC COMPONENT

(71) Applicant: DDK Ltd., Tokyo (JP)

(72) Inventor: Yoshihiro Tadokoro, Tokyo (JP)

(73) Assignee: DDK LTD., Tokyo (JP)

( * ) Notice: Subject to any disclaimer, the term of this patent is extended or adjusted under 35 U.S.C. 154(b) by 0 days.

(21) Appl. No.: 14/784,778

(22) PCT Filed: Apr. 4, 2014

(86) PCT No.: PCT/JP2014/059942
§ 371 (c)(1),
(2) Date: Oct. 15, 2015

(87) PCT Pub. No.: WO2014/178259
PCT Pub. Date: Nov. 6, 2014

(65) Prior Publication Data

US 2016/0064846 A1 Mar. 3, 2016

(30) Foreign Application Priority Data

Apr. 30, 2013 (JP) ..... 2013-095416
Jul. 26, 2013 (JP) ..... 2013-156056

(51) Int. Cl.
*H01R 13/52* (2006.01)
*H01R 13/03* (2006.01)
(Continued)

(52) U.S. Cl.
CPC ..... *H01R 13/035* (2013.01); *C25D 5/12* (2013.01); *C25D 5/48* (2013.01); *C25D 7/00* (2013.01);
(Continued)

(58) Field of Classification Search
CPC ..... H05K 3/282; H05K 2203/0591
(Continued)

(56) References Cited

U.S. PATENT DOCUMENTS 4,268,568 A 5/1981 Sard et al.
4,427,914 A * 1/1984 Mizuno ..... H01T 13/14 313/118
(Continued)

FOREIGN PATENT DOCUMENTS

CN 1855471 A 11/2006
CN 102394413 A 3/2012
(Continued)

OTHER PUBLICATIONS

International Search Report, issued in PCT/JP2014/059942, dated Jul. 8, 2014.
(Continued)

*Primary Examiner* — Phuong Dinh
(74) *Attorney, Agent, or Firm* — Birch, Stewart, Kolasch & Birch, LLP

(57) ABSTRACT

An electronic component includes at least a contact member having, on a surface of a contact portion adapted to come into contact with another contact member, at least an undercoat plating layer and a main plating layer formed on the undercoat plating layer. A coating containing a fluorine-based oil is provided on the main plating layer, and the coating has a dry coating weight per unit area on the main plating layer of greater than or equal to 0.011 mg/cm$^2$.

4 Claims, 11 Drawing Sheets

(51) Int. Cl.

| | |
|---|---|
| ***C25D 5/48*** | (2006.01) |
| ***C25D 7/00*** | (2006.01) |
| ***C25D 5/12*** | (2006.01) |
| *H01R 24/62* | (2011.01) |
| *C25D 3/12* | (2006.01) |
| *C25D 3/48* | (2006.01) |
| *C25D 5/34* | (2006.01) |

(52) U.S. Cl.
CPC ..... *H01R 13/03* (2013.01); *C25D 3/12* (2013.01); *C25D 3/48* (2013.01); *C25D 5/34* (2013.01); *H01R 24/62* (2013.01)

(58) Field of Classification Search
USPC ..... 439/524
See application file for complete search history.

(56) References Cited

U.S. PATENT DOCUMENTS

| | | | | |
|---|---|---|---|---|
| 2006/0134403 | A1 | 6/2006 | Ohwaki et al. | |
| 2006/0237824 | A1 | 10/2006 | Lee et al. | |
| 2015/0280340 | A1* | 10/2015 | Anderson ..... | H01R 13/03 439/524 |

FOREIGN PATENT DOCUMENTS

| | | | |
|---|---|---|---|
| EP | 2533368 | A1 | 12/2012 |
| JP | 59-189196 | A | 10/1984 |
| JP | 60-251285 | A | 12/1985 |
| JP | 8-22858 | A | 1/1996 |
| JP | 2002-343168 | A | 11/2002 |
| JP | 2004-307954 | A | 11/2004 |
| JP | 2005-19103 | A | 1/2005 |
| JP | 2006-173059 | A | 6/2006 |
| JP | 2009-99282 | A | 5/2009 |
| JP | 2010-180425 | A | 8/2010 |
| KR | 10-0671613 | B1 | 1/2007 |
| WO | WO 2010/005088 | A1 | 1/2010 |

OTHER PUBLICATIONS

Written Opinion of the International Searching Authority, issued in PCT/JP2014/059942, dated Jul. 8, 2014.

Extended European Search Report for European Application No. 14791907.0, Dec. 6, 2016.

Korean Office Action for Korean Application No. 10-2015-7034155, dated Jan. 11, 2017, with an English translation thereof.

Chinese Office Action and Search Report with English translation thereof for Chinese Application No. 201480024619.4, issued Oct. 8, 2016.

English translation of the International Preliminary Report on Patentability and Written Opinion of the International Searching Authority (Forms PCT/IB/373 and PCT/ISA/237), dated Nov. 3, 2015, for International Application No. PCT/JP2014/059942.

Chinese Office Action for Appl. No. 201480024619.4 dated Mar. 27, 2017 (w/ English translation).

* cited by examiner

| THICKNESS OF MAIN PLATING LAYER (μm) | DRY DEPOSITION AMOUNT OF PFPE-CONTAINING COATING (mg/cm²) | | | | | | | | | | |
|---|---|---|---|---|---|---|---|---|---|---|---|
| | 0.005 | 0.011 | 0.019 | 0.032 | 0.04 | 0.07 | 0.11 | 0.18 | 0.25 | 0.37 | 0.43 |
| 0.01 | SAMPLE 65 | SAMPLE 66 | SAMPLE 67 | SAMPLE 68 | SAMPLE 69 | SAMPLE 70 | SAMPLE 71 | SAMPLE 72 | SAMPLE 30 | SAMPLE 31 | SAMPLE 32 |
| 0.03 | SAMPLE 57 | SAMPLE 58 | SAMPLE 59 | SAMPLE 60 | SAMPLE 61 | SAMPLE 62 | SAMPLE 63 | SAMPLE 64 | SAMPLE 27 | SAMPLE 28 | SAMPLE 29 |
| 0.05 | SAMPLE 49 | SAMPLE 50 | SAMPLE 51 | SAMPLE 52 | SAMPLE 53 | SAMPLE 54 | SAMPLE 55 | SAMPLE 56 | SAMPLE 24 | SAMPLE 25 | SAMPLE 26 |
| 0.10 | SAMPLE 44 | SAMPLE 45 | SAMPLE 46 | SAMPLE 47 | SAMPLE 48 | SAMPLE 18 | SAMPLE 19 | SAMPLE 20 | SAMPLE 21 | SAMPLE 22 | SAMPLE 23 |
| 0.20 | SAMPLE 40 | SAMPLE 41 | SAMPLE 42 | SAMPLE 43 | SAMPLE 11 | SAMPLE 12 | SAMPLE 13 | SAMPLE 14 | SAMPLE 15 | SAMPLE 16 | SAMPLE 17 |
| 0.40 | SAMPLE 39 | SAMPLE 1 | SAMPLE 2 | SAMPLE 3 | SAMPLE 4 | SAMPLE 5 | SAMPLE 6 | SAMPLE 7 | SAMPLE 8 | SAMPLE 9 | SAMPLE 10 |

FIG. 5

| SAMPLE No. | UNDERCOAT PLATING LAYER | MAIN PLATING LAYER | | DRY DEPOSITION AMOUNT OF PFPE-CONTAINING COATING (mg/cm²) | ANTI-CORROSION TREATMENT | PHOTOGRAPHIC IMAGE OF CONTACT SURFACE |
|---|---|---|---|---|---|---|
| | TYPE | TYPE | THICKNESS (μm) | | | |
| 33 | Ni | Au | 0.005 | 0.25 | N/A | |
| 34 | Ni-P | Au | 0.1 | 0.25 | N/A | |
| 35 | Pd-Ni/Ni | Au | 0.1 | 0.04 | N/A | |
| 36 | Pd-Ni/Ni | Au | 0.1 | 0.18 | N/A | |
| 37 | Pd-Ni/Ni | Au | 0.1 | 0.25 | N/A | |
| 38 | Ni | Ag | 2 | 0.25 | N/A | |
| 73 | Ni | Au | 0.8 | N/A | BENZOTHIAZOL | |
| 74 | Ni-P | Au | 0.8 | N/A | BENZOTHIAZOL | |
| 75 | Ni | Au | 0.8 | N/A | THIOL | |

FIG. 6

ELECTRONIC COMPONENT

CROSS REFERENCE TO RELATED APPLICATIONS

This is the National Stage of International Application No. PCT/JP2014/059942, filed Apr. 4, 2014, which claims the benefit of Japanese Patent Application No. 2013-095416, filed Apr. 30, 2013 and Japanese Patent Application No. 2013-156056, filed Jul. 26, 2013, the disclosure of which are hereby incorporated by reference in their entirety.

TECHNICAL FIELD

The present invention relates to an electronic component such as a connector, a relay, a switch and a terminal used for electric (electronic) equipment such as portable terminals, laptop computers, audio equipment, and digital cameras, and particularly relates to a technique of improving corrosion resistance of a contact member of electronic components.

BACKGROUND ART

Contact members used for electronic components described above may be made of a base material of copper or a copper alloy such as phosphor bronze or brass and a gold plating applied thereon. Gold plating prevents an oxide film, and has a good contact resistance value stability and a good corrosion resistance.

As described in Patent Document 1 below, the applicant has proposed providing an appropriate plating layer between a conductive base material and a main plating layer formed on the conductive base material to prevent corrosion and to improve connection reliability of a contact member, and, according to this proposal, a good result is obtained in a corrosion resistance test using a three-gas mixture flow ($H_2S$, $SO_2$, $NO_2$).

DOCUMENT LIST

Patent Document(s)

Patent Document 1: WO 2010/005088

SUMMARY OF INVENTION

Technical Problem

Recently, connectors for hard disks or flash memories, for example, require a very high reliability. To be more specific, S-ATA (Serial Advanced Technology Attachment) is an interface standard for connection of a hard disk and/or an optical drive to a computer that specifies test specifications and evaluation methods in detail. Among them is a corrosion resistance test using a four-gas mixture flow ($H_2S$, $SO_2$, $NO_2$, $Cl_2$) which imposes more severe test conditions than that of the corrosion resistance test using a three-gas mixture flow described above. Some of the electronic components described in the aforementioned Patent Document 1 do not comply with the corrosion resistance test by a four-gas mixture flow, and thus a further improvement in corrosion resistance is desired. Increasing the thickness of a main plating layer could improve corrosion-resistance, but also has a disadvantage of an increased cost.

Accordingly, it is an object of the present invention to provide an electronic component showing an excellent corrosion resistance in a four-gas mixture flow and having an inexpensive structure.

Solution to Problem

In order to find a solution to the problem, the inventor carried out studies on mechanisms of corrosion by a three-gas mixture flow and corrosion by a four-gas mixture flow, and these will be described below.

<Studies on Corrosion Occurrence Mechanism in a Three-Gas Mixture Test>

(1) First Step

As schematically shown in FIG. 10, immediately after Au plating, Cu atoms in a material (Au/Ni/Cu) diffuse (it is estimated that grain boundary diffusion is dominant), and reach an Au plating surface. Simultaneously, Ni atoms also diffuse, but remain within an Au plating layer due the presence of the Cu atoms that have rapidly diffused and an Au—Cu based intermetallic compounds. These diffusion phenomena that take place rapidly are due to a "diffusion acceleration effect by superabundant vacancy formation", which is a phenomenon specific to plated metals.

(2) Second Step

As schematically shown in FIG. 11, an acidic electrolytic solution is produced by an interaction between a mixed corrosive gas and water, and attaches to an Au plating surface. An interior of a test chamber is under a humidity environment of a relative humidity of 70% RH (temperature 35 C.°), and thus the acid electrolytic solution is produced by dissolution of the corrosive gas into moisture. For example, using a $SO_2$ gas, sulfite ions ($HSO_3^-$) are produced as expressed by formulae (I) and (II) indicated below, and subsequently, react with dissolved oxygen in water as expressed by formula (III) indicated below to produce sulfate ions ($SO_4^{2-}$).

$$SO_2+H_2O \rightarrow H_2SO_3 (\Leftrightarrow HSO_3^- + H^+) \quad \text{reaction formula (I)}$$

$$HSO_3^- \Leftrightarrow SO_3^{2-} + H^+ \quad \text{reaction formula (II)}$$

$$2SO_3^{2-} + O_2 \Leftrightarrow 2SO_4^{2-} \quad \text{reaction formula (III)}$$

(3) Third Step

As schematically shown in FIG. 12, the Au plating serves as cathodes and Cu atoms elute by a local cell mechanism, and the Cu atoms diffuse and dissolve intensively at those locations.

(4) Fourth Step

As schematically shown in FIG. 13, the eluted Cu reacts with sulfate ions, hydroxide ions, hydrosulfide ions contained in the electrolytic solution and the test chamber atmosphere, thus locally produce an insoluble corrosion product composed primarily of Cu, such as $Cu_4(SO_4)(OH)_6$ and sulfide (CuS).

(5) Fifth Step

As schematically shown in FIG. 14, an Au plating grain boundary expands along with production and growth of the Cu-based corrosion product, and thus, including its periphery, the Cu atoms readily diffuse and a spot-like corrosion product is produced. Therefore, a compound composed primarily of Cu including sulfate ions is produced at an initial step of the corrosion.

(6) Sixth Step

As schematically shown in FIG. 15, diffusion of Ni atoms that are present in the Au plating also accelerate along with growth and expansion of the corrosion product of a Cu compound, and the diffusion of the Ni atoms is accelerated inside and at a surface of the Cu corrosion product where diffusion is easy.

(7) Seventh Step

As schematically shown in FIG. 16, the Ni atoms are electrochemically under a strong influence of the local cell mechanism, and thus they dissolve at an accelerating rate. In this step, it is presumed that the dissolution reaction of the Cu atoms stops.

(8) Eighth Step

As schematically shown in FIG. 17, a compound of Ni including sulfate ions is eventually produced, and further, diffusion of the Ni atoms is accelerated (a quantity of ionized Ni atoms is supplied) and these phenomena occurs continuously, a void is formed in the Ni plating layer as shown in FIG. 18.

As can be seen from the mechanism described above, suppression of the diffusion of Ni and Cu is effective in preventing corrosion, and a significant enhancement in corrosion resistance is achieved by applying an amorphous Ni—P alloy plating as an undercoat for an Au plating.

<Studies on Corrosion Occurrence Mechanism in Four-Gas Mixture Test>

A four-gas mixture test, which is a corrosion resistance test standard under S-ATA, was carried out using Au/Ni/Brass and Au/Ni—P/Brass connectors, and the result showed that the undercoat Ni—P alloy plating which had a high corrosion resistance in a three-gas mixture test did not satisfy the standard (S-ATA standard) for the four-gas mixture test, and merely showed a corrosion resistance which is substantially the same as a normal undercoat Ni plating. Therefore, a corrosion occurrence mechanism for the four-gas mixture test for Au/Ni/Brass or Au/Ni—P/Brass will described with reference to a corrosion occurrence mechanism for the three-gas mixture test.

In the first step, Zn and Cu diffuse in the Au plating layer, but it is presumed that an absolute amount of the diffusion is less for the undercoat Ni—P alloy plating. In the second step, a compound of Zn and Cu is produced by an electrolytic solution attached to an Au plating surface (mainly a Cu compound in the undercoat Ni—P). In the third step, since diffusion of Ni accelerates along with the progress of corrosion, a Ni compound is produced (mainly a Cu compound in the undercoat Ni—P). Although reaction kinetics has not been discussed and thus it is not uncertain, it can be considered that an Au plating is dissolved by nitrosyl chloride and chloride ions simultaneously with or prior to the second and third steps. Therefore, all metals including Zn, Cu and Ni which were present in the Au plating are readily corroded at an accelerated rate. In the undercoat Ni—P plating, the corrosion product of Ni is almost not observed. However, from the above discussion, it is presumed that the corrosion product of Ni is eventually produced in the undercoat Ni—P alloy plating depending on the test duration.

In this manner, using an actual connector, a four-gas mixture test ($H_2S$, $SO_2$, $NO_2$, $Cl_2$), which is a corrosion resistance test standard under S-ATA, was carried out and corrosion resistance and an electrical contact characteristic were examined, but, even in the undercoat Ni—P plating which showed an excellent corrosion resistance in a three-gas mixture test ($H_2S$, $SO_2$, $NO_2$), the corrosion resistance was very bad, and it was clear that the test standard is not satisfied. It is presumed that the main factor is that, due to the presence of a $Cl_2$ gas, nitrosyl chloride that accelerates the diffusion of Au is produced, and that corrosion progresses at an accelerated rate. Further, dissolution of Au was also implied by an interaction between chloride ions and coexisting sulfate ions. Therefore, in order to satisfy the four-gas mixture test standard, it is presumed that a metal (such as Rh and Ir) having a high corrosion resistance even in a mixed acid (aqua regia) of hydrochloric acid and nitrate nitrating acid is effective. However, although plating solutions of these noble metal plating do exist, they are expensive and are low-speed plating solutions (used in a low-current density region: rack plating or barrel plating application), it is not suitable for products requiring a high-speed productivity such as a connector. Also, considering that it is necessary to satisfy at least the electrical contact properties or soldering characteristics, these noble metal platings are not effective.

Further, there is a possibility that these noble metals locally dissolve due to an action other than those in the studies described above and that is not clarified. Thus, the inventor came to consider that the possibility to satisfy the four-gas mixture test was extremely low with only a metal plating including Au, and that the most suitable method to prevent corrosion in the four-gas mixture test is a technique in which an anti-corrosion agent is applied after a plating process, and a certain kind of coating is formed on the Au plating surface.

Various existing anti-corrosion agents (sealing process agents) used after plating are known such as a water-soluble, alcohol solvent and a hydrocarbon solvent. Basically, these are in many cases thiol-based or azole-based derivative (water-soluble is a compound of Na or K salt), and considered to forms a self-assembled film of about 100 Å on the Au plating surface. Since the hydrocarbon solvent is an agent which is commonly referred to as an oil-based treating agent, it is physically absorbed onto the Au plating surface. Therefore, the Au plating surface is covered with a film of an order of a few to several μm in some cases, and there is a very high risk of causing defects in an electrical contact depending on how it is used (mainly concentration of the oil), and there is actual harm. Accordingly, it was considered to use a thiol-based derivative and an azole-based derivative for anti-corrosion treatment. However, when an experiment was carried out with a water-soluble anti-corrosion treating agent (benzotriazole-based potassium salt) being applied to the Au plating surface, it was found that no effect was obtained. Furthermore, an experiment that was carried out with a connector on which a thiol-based treating agent with an alcohol-based solvent (combined alcohol containing ethanol, 2-propanol and methanol) is applied, and, similarly to the water-solubility treating agent, almost no effect was obtained. Regarding this factor, it can be considered that factors described below by an evaluation using connectors are greatly involved.

1) Addition of a Thermal Energy in a Soldering Step (Reflow Mounting)

2) Addition of Physical and Mechanical Energy by a Durability Test (Insertion Extraction)

With the former factor, after maintaining in a range of 150 C.° to 190 C.° for approximately 90 seconds (pre-heating step), a thermal history of 230 C.° or higher for approximately 30 seconds (maximum of 245 C.° to 260 C.° for 5 seconds) is added. Therefore, with this thermal energy, detachment of a thiol group which is chemically bonded to the Au plating surface is implied (reported as being 400 K to 450 K), and also there is a possibility that molecules itself including the thiol group vaporizes. That is, it is implied that detachment may occur at a stage of pre-heating in the soldering step. Therefore, as an anti-corrosion treatment film to be formed on the Au plating surface, there is a need to apply an organic compound (anti-corrosion treating agent) which can exist stably in the range of 240 C.° to 260 C.°. Also, although the soldering step is for a short period of time of a total of about 90 to 120 seconds, since a thermal energy of 150 C.° or higher is added, as shown in the aforementioned corrosion occurrence mechanism, it is considered that diffusion of Cu atoms and Ni atoms is accelerated, and, corrosion is likely to occur by the soldering step.

A connector after a reflow mounting is subjected to an insertion and extraction test of a connector listed in the latter factor to check the durability, and an imprint called an insertion-extraction trace, which is formed upon mating of a receptacle connector of a counterpart, is observed on the contact surface. This is an inevitable phenomenon from the point of view of keeping an electrical contact between Au of a plug side and the Au plating of a receptacle connector side. Therefore, even if an anti-corrosion treatment film remains by a former thermal history, it is conceivable that it is physically removed in the insertion and extraction step of the connector. Thus, it is presumed that a compound that wets and spreads uniformly on the contact of the connector and that clears at the time of insertion of the receptacle connector and restored to an initial state at the time of extraction is considered to be effective. That is, a material having a low surface tension and a self-recovery function is desired.

From the above-mentioned results and discussions, it is conceivable that a material having both an excellent heat resistance and fluidity (uniform dispersibility, self-recovery function) is suitable for an anti-corrosion treatment film to be applied to satisfy a four-gas mixture test. Also, because chloride ions and sulfate ions are formed in the four-gas mixture test, and specifically because a possibility of breakage of an anti-corrosion treatment coating by action in the former is implied, there is a need to consider a chemically stable and inert characteristic. A fluorine-based lubricant is one of the candidates of a material having both of these characteristics. However, due to its properties (such as repellency, insulating property and lubricity), it is used for a portion that should avoid water (mounting board) as well as components and products requiring abrasion resistance (repeated sliding) (e.g., hard disks). Since these contain particles (e.g., PTFE or $MoS_2$) of a solid content and also form a solid film on a surface, insulating properties and abrasion resistance improve. For these reasons, as far as it is known, there is no such precedent example that it was applied to a portion to be used for the purpose of an electrical contact, and, actually, it has been observed that when an initial contact resistance value is measured, it is not an electrically conductive state. Thus, it was considered that a fluorine-based lubricant including a solid content is inappropriate concerning the performance (contact resistance) and the appearance (plating surface comes to a hue of solid particles), and considered that a clear and colorless fluorine system lubricating oil (e.g., perfluoropolyether (PFPE)) which does not form a solid film and is comprised only of oil is most suitable. Also, it was considered that it is appropriate to use a fluorine-based inert liquid (e.g., hydrofluoroether (HFE)) as a solvent to uniformly disperse fluorine-based lubricating oil on the surface of the plating layer.

The present invention was obtained as a result of carrying out assiduous studies, and an electronic component of the present invention includes at least a contact member having, on a surface of a contact portion adapted to come into contact with another contact member, at least an undercoat plating layer and a main plating layer formed on the undercoat plating layer, wherein a coating containing a fluorine-based oil is provided on the main plating layer, and the coating has a dry coating weight per unit area of greater than or equal to 0.011 mg/cm$^2$ on the main plating layer. Here, a "dry coating weight" refers to a coating build-up at room temperature (25 C.°) and under atmospheric pressure. The dry coating weight can be obtained by, for example, measuring a weight prior to applying a fluorine-based oil and a weight after a fluorine-based oil has been applied and dried, using a micro-balance (measurement accuracy of ±0.1), and subtracting the weight before application from the weight after the application, and dividing the weight difference by a surface area of the main plating layer whereon the fluorine system oil is attached.

Also, as for the electronic component of the present invention, it is preferable that the dry coating weight is greater than or equal to 0.25 mg/cm$^2$.

Further, as for the electronic component of the present invention, it is preferable that the main plating layer is an Au-containing plating layer.

Further, as for the electronic component of the present invention, it is preferable that the main plating layer has a thickness of less than or equal to 0.4 μm.

Further, as for the electronic component of the present invention, it is preferable that the undercoat plating layer is one of a Ni plating layer, an electrolytic Ni—P plating layer, a Pd—Ni plating layer, and a composite plating layer of a Ni plating layer and a Pd—Ni plating layer.

Further, as for the electronic component of the present invention, it is preferable that the fluorine-based oil is a perfluoropolyether oil (PFPE oil).

Effects of Invention

As for the electronic component of the present invention, a coating containing a fluorine-based oil is provided on a surface of a contact member, and the coating has a dry coating weight of greater than or equal to 0.011 mg/cm$^2$. Accordingly, even if the thickness of the main plating layer is decreased, a contact member can be protected from oxygen, corrosive gas, moisture or the like by the coating, and a high corrosion resistance is obtained. The fluorine-based oil composing the coating is, because of its fluidity, pushed away into micro recesses in the surface when the contact members come into contact with each other, and thus does not affect conductivity and a stable conductivity can be obtained.

Therefore, according to the present invention, an electronic component showing an excellent corrosion resistance can be provided for a four-gas mixture flow with an inexpensive structure.

BRIEF DESCRIPTION OF DRAWINGS

FIG. 5 shows photographic images of surfaces of contacts of connectors of Samples 1 to 32 and Samples 39 to 72 after a test.

FIG. 6 shows photographic images of contacts of connectors of Samples 33 to 38 and Samples 73 to 75 after a test.

FIGS. 7A and 7B show the result of a salt spray test, in which FIG. 7A is a photographic image showing a part of the surface condition observation result of the contacts after the salt spray test, and FIG. 7B is a graph indicating a contact resistance value before and after the salt spray test.

FIGS. 8A and 8B show the result of a two-gas mixture test, in which FIG. 8A is a photographic image showing a part of the surface condition observation result of the contacts after the two-gas mixture test, and FIG. 8B is a graph indicating a contact resistance value before the test, a contact resistance value after 500 times of insertion and extraction, and a contact resistance value after exposure to a two-gas mixture flow.

DESCRIPTION OF THE PREFERRED EMBODIMENTS

Preferred embodiments of the present invention will be described below in detail with reference to the attached drawings. Note that a connector for an interface is taken as an example of an electronic component in the description, but the present invention is not limited thereto, and is applicable to various kinds of electronic component having a contact member such as a relay or a switch. Also, the present invention is not only applicable to a connector for an interface, but is applicable to various kinds of connectors such as connectors for FPC/FFC or SIM cards.

Figure 1:
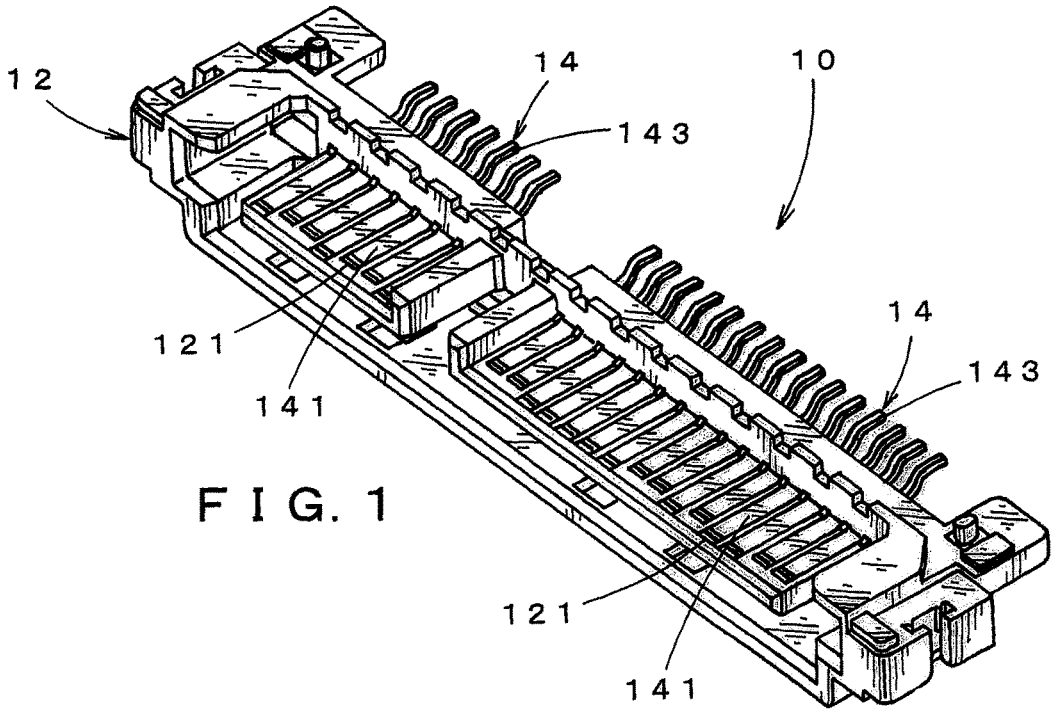
FIG. 1 is a perspective diagram showing a connector from a bottom side according to an embodiment of the present invention.

As shown in FIG. 1, a connector (plug) 10 of the present embodiment includes a housing 12 and a plurality of contacts 14 as a contact member held by the housing 12.

Figure 2:
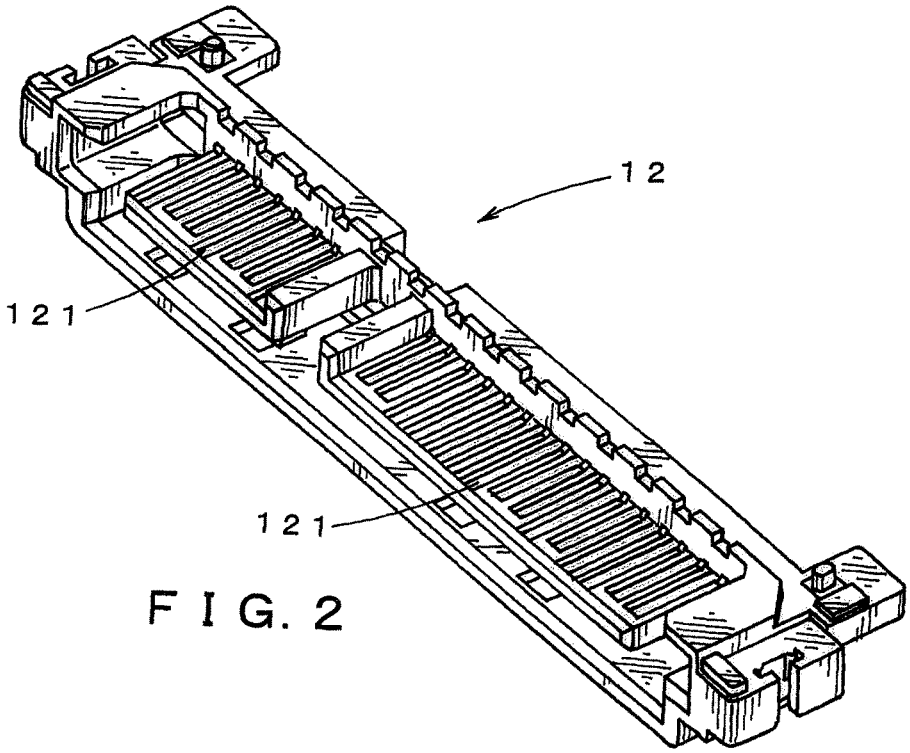
FIG. 2 is a perspective diagram showing a housing of the connector of FIG. 1.

As shown in FIG. 2, the housing 12 is formed of electrically insulating plastic and may be fabricated by a known injection molding technique. The material is appropriately selected in consideration of dimensional stability, workability, cost, and the like, and generally selected from polybutylene terephthalate (PBT), polyamide (66PA, 46PA), a liquid crystal polymer (LCP), polycarbonate (PC), polytetrafluoroethylene (PTFE) or a synthetic material thereof.

The housing 12 is provided with a desired number of insertion holes 121 through which the contact 14 are to be inserted and a fitting opening in which FPC or FFC is inserted. In the present embodiment, the contacts 14 are held in the housing 12 by welding, but the contacts 14 may be held in the housing 12 by a known technique such as press fitting or engaging.

Figure 3:
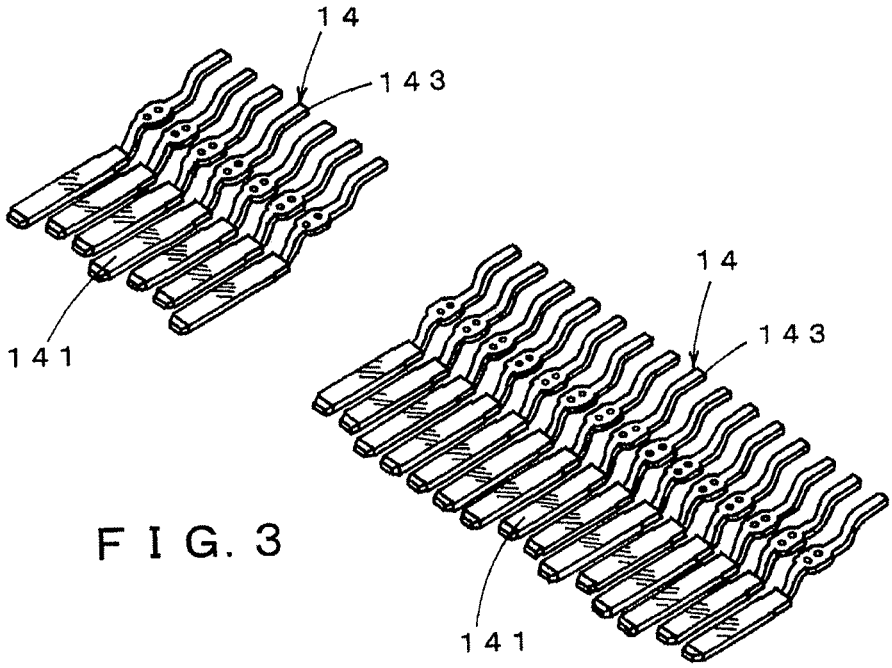
FIG. 3 is a perspective diagram showing a contact of the connector of FIG. 1.

As shown in FIG. 3, each of the contacts 14 includes a contact portion 141 that is adapted to come into contact with a connector (receptacle), which is an object to be connected, not shown, and a connecting portion 143 adapted to be connected to a substrate or a cable, and the contacts 14 can be fabricated by a known processing method such as pressing or machining.

Figure 4:
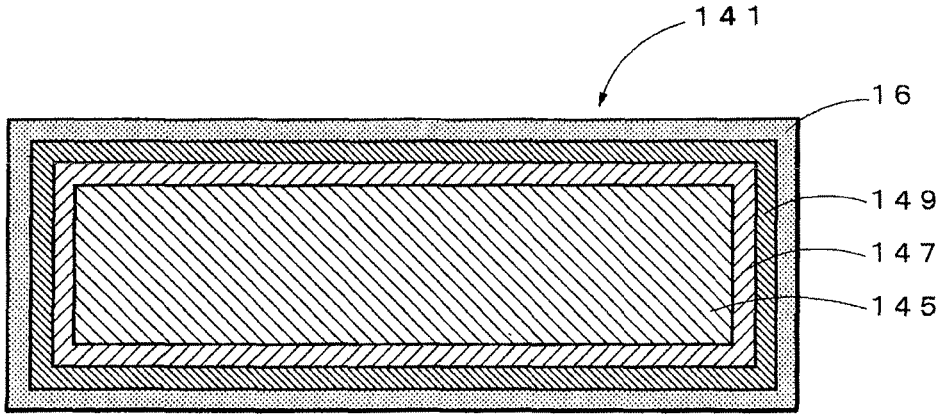
FIG. 4 is a cross section at a contact portion of the contact constituting the connector of FIG. 1.

Also, as schematically shown in FIG. 4, the contact portion 141 of the contact includes an undercoat plating layer 147 stacked on a surface portion of a conductive substrate 145 and a main plating layer 149 on the undercoat plating layer 147. A coating 16 is shown on a surface of main plating layer 149.

It is preferable that conductive substrate 145 is made of known various kinds of metal, e.g., made of copper or made of a copper alloy. The copper alloy may be phosphor bronze, beryllium copper, brass, or the like, and it is preferable that it is made of phosphor bronze when corrosion resistance is of importance.

It is preferable that the main plating layer 149 is one of Au-containing plating, Ag-containing plating, Pd-containing plating, Pd—Ni plating, Sn plating and Sn-based alloy plating. This is because contact stability, corrosion resistance and solder wettability are good. Also, it is preferable that the main plating layer 149 is an Au-containing plating when corrosion resistance is of particular importance.

It is preferable that the main plating layer 149 has a thickness of 0.03 μm to 6.0 μm, although it depends on the material of the main plating. For example, in a case where the main plating layer 149 is an Au-containing plating layer, it is desirable that the thickness is about 0.1 μm to 1.0 μm for a portion where electric reliability is necessary (contact portion) and about 0.03 μm to 0.20 μm for a portion where reliability of the soldering is necessary. Also, in a case where the main plating layer 149 is a Pd-containing plating or a Pd—Ni plating, it is similarly desirable to be about 0.1 μm to 1.0 μm for a portion where electric reliability is necessary and about 0.03 μm to 0.20 μm for a portion where reliability of the soldering is necessary. Further, in order to improve corrosion resistance, the main plating layer 149 comprising an Au-containing plating layer or a Pd-containing plating layer may have a thickness of greater than 1.0 μm, but considering the cost, it is preferable that a thickness is less than or equal to 1.0 μm, and it is more preferable that a thickness is less than or equal to 0.4 μm. On the other hand, in a case of an Ag-containing plating, Sn plating and Sn-based alloy plating, the thickness is preferably 2.0 μm to 6.0 μm to ensure good electrical reliability and soldering reliability.

It is preferable that the undercoat plating layer 147 is one of a Ni—P plating layer, a Ni plating layer, a Pd—Ni plating layer, and a composite plating layer of a Ni plating layer and a Pd—Ni plating layer. When corrosion resistance is of particular importance, it is preferable that the undercoat plating layer 147 is a Ni—P plating layer. In this case, it is preferable that P density is 2.0 weight % to 18 weight %.

This is because when P concentration is less than 2.0 weight %, corrosion resistance might decrease, and when P concentration is greater than 18 weight %, ductility is poor and could cause breaks such as cracks. It is preferable that the Ni—P plating layer has a thickness of 0.5 μm to 6.0 μm. This is because, in a case where the thickness is less than 0.5 μm, corrosion resistance might decrease due to diffusion of copper, zinc, etc., that are included in the copper alloy, and when it is greater than 6.0 μm, ductility is poor and could cause breaks such as cracks.

The Ni—P plating layer can be formed, for example, by an electroplating method using a Watts bath or a sulfamate bath. Particularly, it is preferable to be formed by an electroplating method using a bath based on sulfuric acid in which phosphorous acid is added to a Watt bath. This is because it is possible to form a layer in which crystals are dense, a surface activity is high, and an interface reactivity with the main plating layer 149 such as Au of the upper layer is good.

Further, in order to achieve higher corrosion resistance, the connector 10 includes a coating 16 containing a fluorine system oil on at least the surface of the contact portion 141 on the main plating layer 149 of the contact 14. The coating 16 for improving corrosion resistance needs not only protect the contact 14 from oxygen, moisture, and corrosive gas, but also not to inhibit electricity property. Further, it is required to have heat resistance such that detaching or resolving does not occur at a mounting temperature (up to 260° C.), have lubricity, have a small surface tension and an improved uniform dispersibility (self-recovery capacity), and further inert to chloride ions and sulfate ions.

The fluorine-based oil may include perfluoropolyether-based oils (PFPE oils), and among these, it is particularly preferable to use a perfluoropolyether-based oil (PFPE) which is a polymeric fluorine-based compound having a skeleton of [—$CF_2$—O—], a surface tension (25° C.) of less than or equal to 25 mN/m, and a mean molecular weight of 500 to 15,000. Perfluoropolyether-based oils may be those having structural formulae indicated in Table 1 below.

TABLE 1

| No. | STRUCTURAL FORMULA | SURFACE TENSION (mN/m) at 20° C. |
|---|---|---|
| 1 | $F-(CF_2CF_2CF_2O)_n-CF_2CF_3$ | 17-20 |
| 2 | $CF_3-(CF_2CF_2O)_n(OCF_2)_m-OCF_3$ | 16-17 |
| 3 | $F-(CF(CF_3)F_2O)_n-CF_2CF_3$ | 18-20 |
| 4 | $CF_3-(CF(CF_3)F_2O)_n(OCF_2)_m-CF_3$ | 14-20 |
| 5 | $CF_3-O-(CF_2CF_2CF_2)_n(OCF_2)_m-CF_3$ | 19-20 |
| 6 | $CF_3-O-(CF_2CF_2CF_2O)_n(OCF_2)_m-CF_3$ | 18-19 |
| 7 | $CF_3-O-(CF_2CF_2O)_n(OCF_2)_m-CF_3$ | 25 |
| 8 | $HOCH_2-CF_2O-(CF_2CF_2O)_n(OCF_2)_m-CF_2-CH_2OH$ | 23 |

For example, for such PFPE oil, "SANKOL ZZS-202" (SANKOL ZZS-202) (product name) available from Sankei Kagaku Co., Ltd. (SANKEIKAGAKU CO., LTD.) can be appropriately used.

As a method of forming the coating on the main plating layer 149 includes, for example, immersing the contact 14 in a solution (coating liquid) obtained by diluting a fluorine system oil with a solvent for a few to several seconds (one or more seconds) and evaporating the solvent to form the coating 16 on the surface of the contact 14. For example, HFE described below evaporates instantly in about a few to several seconds and thus only PFPE can be remained on the surface of the contact 14. Such an application work can be performed continuously by a reel to reel method.

As for the solvent, a fluorine-based solvent which has a good dispersibility with the fluorine-based oil is preferable, and, for example, it is preferable to use hydrofluoroether (HFE). Hydrofluoroether may be those having structural formulae indicated in Table 2 below.

TABLE 2

| No. | STRUCTURAL FORMULA | VAPOR PRESSURE (kPa, 25° C.) | SURFACE TENSION (mN/m) |
|---|---|---|---|
| 1 | $CF_3-(CF_2)_3-OCH_3$ | 28 | 13-14 |
| 2 | $CF_3-(CF_2)_3-OC_2H_5$ | 16 | 13-14 |
| 3 | $CF_3-(CF_2)_3-OCH_3$ | 6 | 14-15 |

For example, for such HFE, "SANKOLCFD diluent Z" (SANKOL CFD DILUENT Z) (product name) which is available from Sankei Kagaku Co., Ltd. (SANKEIKAGAKU CO., LTD.) can be appropriately used.

It is to be noted that if an analytical curve of concentration of the fluorine-based oil to the solvent in the coating liquid and the dry coating weight per unit area of the coating 16 attached on a surface of the contact 14 is made in advance, the coating 16 of a desired dry coating weight can be readily formed on the surface of contact 14 simply by adjusting the concentration of the coating liquid. As an exemplary method of forming a coating using a PFPE oil and HFE, the relationship between the concentration of the PFPE oil to HFE and the dry coating weight of the coating was examined using a test piece including a Ni plating layer and an Au plating layer formed on a pure copper plate, and the results are indicated in Table 3 below.

TABLE 3

| CONCEN-TRATION OF PFPE (wt %) | TOTAL DRY COATING WEIGHT (mg) | TEST PIECE SURFACE AREA ($cm^2$) | DRY COATING WEIGHT PER UNIT AREA ($mg/cm^2$) |
|---|---|---|---|
| 0.1 | 0.20 | 40.5 | 0.005 |
| 0.2 | 0.35 | 31.5 | 0.011 |
| 0.5 | 0.51 | 17 | 0.019 |
| 0.8 | 0.72 | 22.5 | 0.032 |
| 1 | 0.8 | 22.5 | 0.04 |
| 3 | 2.0 | 18 | 0.11 |
| 5 | 3.2 | 18 | 0.18 |
| 7 | 3.4 | 13.5 | 0.25 |
| 10 | 5.0 | 13.5 | 0.37 |
| 12 | 5.8 | 13.5 | 0.43 |
| 15 | 8.9 | 13.5 | 0.66 |
| 17 | 10.4 | 13.5 | 0.77 |
| 20 | 19.0 | 13.5 | 1.41 |
| 24 | 29.5 | 13.5 | 2.19 |

Now, corrosion resistance can be improved by forming the coating 16 containing fluorine-based oil on the surface of the contact 14, but in order to obtain corrosion resistance to such an extent to conform with a corrosion resistance test under a severe condition by the four-gas mixture flow while attempting to reduce the thickness of the main plating layer 149, it is essential that the dry coating weight per unit area of the coating 16 is greater than or equal to 0.011 $mg/cm^2$. If the dry coating weight per unit area of the coating 16 is less than 0.011 $mg/cm^2$, it is difficult to obtain desired corrosion resistance in the corrosion resistance test under such a severe condition stated above, unless the main plating layer 149 is formed with a considerable thickness. This is because an effect of protecting the undercoat plating layer 147 by cooperation of the main plating layer 149 and the coating 16 cannot be obtained sufficiently.

If the dry coating weight of the coating 16 is greater than or equal to 0.25 $mg/cm^2$, it is preferable since a good corrosion resistance can be obtained in a broader thickness region of the main plating layer 149. In order to achieve both the reduced thickness and the corrosion resistance simultaneously for the main plating layer 149 at a higher dimension, it is preferable that: in a case where the main plating layer 149 has a thickness of greater than or equal to 0.4 μm, the dry coating weight per unit area of fluorine-based-oil-containing coating 16 on the main plating layer 149 is greater than or equal to 0.011 $mg/cm^2$; in a case where the main plating layer 149 has a thickness of greater than or equal to 0.2 μm and less than 0.4 μm, the dry coating weight of the coating 16 is greater than or equal to 0.04 $mg/cm^2$; in a case where the main plating layer 149 has a thickness of greater than or equal to 0.1 μm and less than 0.2 μm; the dry coating weight of coating 16 is greater than or equal to 0.07 $mg/cm^2$; and in a case where the main plating layer 149 has a thickness of less than 0.1 μm, the dry coating weight of the coating 16 is greater than or equal to 0.25 $mg/cm^2$.

According to the contact 10 of the present embodiment described above, the coating 16 deposited by an appropriate amount can protect the contact 10 from oxygen, corrosive gas, moisture, etc., by cooperating with the main plating layer 149, high corrosion resistance can be obtained. The fluorine-based oil composing a coating 16 is, because of its fluidity, pushed away into micro recesses in the surface when the contacts come into contact with each other, and thus does not affect conductivity and thus a stable conductivity can be obtained. Particularly, with the main plating layer 149 having a thickness of less than or equal to 0.4 μm, an amount used of an expensive material (gold plating) can be reduced and a large cost cut is possible.

EXAMPLES

Tests carried out to verify the effects of the present invention will be described below.

First Example

Examples

As Sample 1, a conductive substrate formed of phosphor bronze (Cu: remaining mass %, Sn: 6 weight % to 9 weight %, P: 0.3 weight % to 0.35 weight % and incidental impurities) machined into a predetermined contact shape was prepared, and, the conductive substrate was subjected to alkali cathode electrolytic degreasing under the condition of: sodium orthosilicate concentration of 50 g/l; bath temperature of 55° C.; cathode current density of 10 $A/dm^2$; and duration of electrolysis of 30 seconds, rinsed with water, and thereafter subjected to acid cleaning under the condition of: hydrochloric acid concentration of 10 vol %; bath temperature of 20° C., and immersion duration of 10 seconds. After rinsing with water, a Ni plating layer was formed on a surface portion of phosphor bronze under the condition of: bath composition of a sulphate bath (Watts bath); pH of 4.0; bath temperature of 50° C.; and current density of 10 $A/dm^2$, and, further, on this Ni plating layer, an Au plating layer was formed under the condition of: bath composition of gold (I) potassium cyanide ($KAu(CN)^2$) 12.5 g/l; cobalt sulfate ($CoSO_4 7H_2O$) of 400 ppm; additive of 12.5 ml/l; bath temperature of 50° C.; and current density of 3 $A/dm^2$. Thereafter, on the Au plating layer, a coating liquid in which PFPE oil is diluted with HFE to a predetermined concentration was applied to form a coating containing PFPE. Thereafter, the contact was assembled to the housing shown in FIG. 1 to provide a connector of Sample 1. The thickness of the Ni plating layer, the thickness of the Au plating layer, and the dry coating weight of the PFPE-containing coating are as indicated in Table 3. Note that "Sankol ZZS-202" (SANKOL ZZS-202) (product name) available from Sankei Kagaku Co., Ltd. (SANKEIKAGAKU CO., LTD.) was used as the PFPE. Also, "SANKOLCFD diluent Z" (SANKOL CFD DILUENT Z) (product name) which is available from Sankei Kagaku Co., Ltd. (SANKEIKAGAKU CO., LTD.) was used as the solvent.

Similarly, connectors of samples 2 to 33 that are different from sample 1 merely in their thickness of the Ni plating layer, thickness of the Au plating layer and dry coating weight of the PFPE-containing coating were fabricated. The thickness of the Ni plating layer, the thickness of the Au plating layer and the dry coating weight of the PFPE-containing coating are as indicated in Table 4.

A connector of sample 34 was fabricated with a method similar to a method for sample 1 except that the Ni plating layer was replaced with an electrolysis Ni—P plating layer formed under the condition of: bath composition of sulphate bath (phosphorous acid component); pH of 2.5; bath temperature of 60° C.; and current density of 10 A/dm$^2$. The thickness of the Ni plating layer, thickness of the Au plating layer and the dry coating weight of the PFPE-containing coating are as shown in Table 4.

Connectors of samples 35 to 37 were fabricated with a method similar to a method for sample 1 except that a Pd—Ni plating layer was formed between the Ni plating layer and the Au plating layer under a condition of: bath composition of a low ammonia bath; PH of 7.5; bath temperature of 45° C.; and current density of 10 A/dm$^2$. The thickness of the Pd—Ni/Ni plating, thickness of the Au plating and the dry coating weight of the PFPE-containing coating are as shown in Table 4.

A connector of sample 38 was fabricated with a method similar to a method for sample 1 except that the Au plating layer was replaced with a Ag plating layer under a condition that: bath composition of a cyanidation bath; PH of 12; bath temperature of 15° C. to 25° C.; and current density of 2 A/dm$^2$. The thickness of the Ni plating layer, the thickness of the Ag plating layer and the dry coating weight of the PFPE-containing coating are as shown in Table 4.

Comparative Examples

Connectors of samples 39 to 72 were fabricated with a method similar to a method for sample 1 except that the thickness of the Au plating layer and the dry coating weight of PFPE-containing coating were out of scope of the present invention.

A connector of sample 73 was fabricated with a method similar to a method for sample 1 except that the PFPE-containing coating was replaced with a benzothiazole-based water-soluble corrosion preventing agent applied on the Au plating layer.

A connector of sample 74 was fabricated with a method similar to a method for sample 73 except that an electrolysis Ni—P plating layer was formed in place of the Ni plating layer.

A connector of sample 75 was fabricated with a method similar to a method for sample 73 except that a thiol solvent-based corrosion preventing agent of was applied on the Au plating layer in place of the benzothiazole-based water-soluble corrosion preventing agent.

(Corrosion Resistance Test by Four-Gas Mixture Flow)

A corrosion resistance test was conducted by steps (a) to (e) below.

(a) Measurement of initial contact resistance value (measured by direct current four-probe method)

(b) 50 times of insertion and extraction (c) Measurement of contact resistance value (d) Exposure to four-gas mixture flow (168 hours, unmated)

(e) Measurement of contact resistance value.

Note that, the four-gas mixture test complies with EIA standard (EIA-364-65A), and type and density of gases are: $H_2S$ 10±5 ppb; $SO_2$ 100±20 ppb; $NO_2$ 200±50 ppb; $Cl_2$ 10±3 ppb; temperature 30° C.; and humidity 75% RH.

(Evaluation Method)

When a contact resistance value after exposure to a four-gas mixture flow was less than 25 mΩ, which is approximately equal to an initial contact resistance value, it was evaluated as having an excellent corrosion resistance and satisfying the S-ATA standard, which is denoted by "◎". When the contact resistance value was greater than or equal to 25 mΩ and less than 45Ω, it was evaluated as having a good corrosion resistance, but not as good as ◎ and satisfying the S-ATA standard, which is denoted by "○". Further, when a contact resistance value was greater than or equal to 45 mΩ and less than 200 mΩ, it was evaluated that the corrosion resistance is not sufficient and does not satisfy the S-ATA standard, which is denoted by "Δ". Further, when a contact resistance value was greater than or equal to 200 mΩ, it was evaluated as having a low corrosion resistance, which is denoted by "x". Evaluation results are indicated in Tables 4-1 to 4-4.

TABLE 4-1

| SAMPLE No. | UNDERCOAT PLATING LAYER TYPE | UNDERCOAT PLATING LAYER THICKNESS (μm) | MAIN PLATING LAYER TYPE | MAIN PLATING LAYER THICKNESS (μm) | DRY COATING WEIGHT OF PFPE-CONTAINING COATING (mg/cm$^2$) | ANTI-CORROSION TREATMENT | EVALUATION |
|---|---|---|---|---|---|---|---|
| 1 | Ni | 2.5 | Au | 0.4 | 0.011 | N/A | ○ |
| 2 | Ni | 2.5 | Au | 0.4 | 0.019 | N/A | ◎ |
| 3 | Ni | 2.5 | Au | 0.4 | 0.032 | N/A | ◎ |
| 4 | Ni | 2.5 | Au | 0.4 | 0.04 | N/A | ◎ |
| 5 | Ni | 2.5 | Au | 0.4 | 0.07 | N/A | ◎ |
| 6 | Ni | 2.5 | Au | 0.4 | 0.11 | N/A | ◎ |
| 7 | Ni | 2.5 | Au | 0.4 | 0.18 | N/A | ◎ |
| 8 | Ni | 2.5 | Au | 0.4 | 0.25 | N/A | ◎ |
| 9 | Ni | 2.5 | Au | 0.4 | 0.37 | N/A | ◎ |
| 10 | Ni | 2.5 | Au | 0.4 | 0.43 | N/A | ◎ |
| 11 | Ni | 2.5 | Au | 0.2 | 0.04 | N/A | ○ |
| 12 | Ni | 2.5 | Au | 0.2 | 0.07 | N/A | ○ |
| 13 | Ni | 2.5 | Au | 0.2 | 0.11 | N/A | ○ |
| 14 | Ni | 2.5 | Au | 0.2 | 0.18 | N/A | ◎ |
| 15 | Ni | 2.5 | Au | 0.2 | 0.25 | N/A | ◎ |
| 16 | Ni | 2.5 | Au | 0.2 | 0.37 | N/A | ◎ |
| 17 | Ni | 2.5 | Au | 0.2 | 0.43 | N/A | ◎ |

TABLE 4-2

| SAMPLE No. | UNDERCOAT PLATING LAYER TYPE | UNDERCOAT PLATING LAYER THICKNESS (μm) | MAIN PLATING LAYER TYPE | MAIN PLATING LAYER THICKNESS (μm) | DRY COATING WEIGHT OF PFPE-CONTAINING COATING ($mg/cm^2$) | ANTI-CORROSION TREATMENT | EVALUATION |
|---|---|---|---|---|---|---|---|
| 18 | Ni | 2.5 | Au | 0.1 | 0.07 | N/A | ○ |
| 19 | Ni | 2.5 | Au | 0.1 | 0.11 | N/A | ○ |
| 20 | Ni | 2.5 | Au | 0.1 | 0.18 | N/A | ○ |
| 21 | Ni | 2.5 | Au | 0.1 | 0.25 | N/A | ○ |
| 22 | Ni | 2.5 | Au | 0.1 | 0.37 | N/A | ○ |
| 23 | Ni | 2.5 | Au | 0.1 | 0.43 | N/A | ◎ |
| 24 | Ni | 2.5 | Au | 0.05 | 0.25 | N/A | ○ |
| 25 | Ni | 2.5 | Au | 0.05 | 0.37 | N/A | ○ |
| 26 | Ni | 2.5 | Au | 0.05 | 0.43 | N/A | ○ |
| 27 | Ni | 2.5 | Au | 0.03 | 0.25 | N/A | ○ |
| 28 | Ni | 2.5 | Au | 0.03 | 0.37 | N/A | ○ |
| 29 | Ni | 2.5 | Au | 0.03 | 0.43 | N/A | ○ |
| 30 | Ni | 2.5 | Au | 0.01 | 0.25 | N/A | ○ |
| 31 | Ni | 2.5 | Au | 0.01 | 0.37 | N/A | ○ |
| 32 | Ni | 2.5 | Au | 0.01 | 0.43 | N/A | ○ |
| 33 | Ni | 2.5 | Au | 0.005 | 0.25 | N/A | ○ |
| 34 | Ni—P | 2.5 | Au | 0.1 | 0.25 | N/A | ◎ |
| 35 | Pd—Ni/Ni | 0.5/2.5 | Au | 0.1 | 0.04 | N/A | ◎ |
| 36 | Pd—Ni/Ni | 0.5/2.5 | Au | 0.1 | 0.18 | N/A | ◎ |
| 37 | Pd—Ni/Ni | 0.5/2.5 | Au | 0.1 | 0.25 | N/A | ◎ |
| 38 | Ni | 2.5 | Au | 2 | 0.25 | N/A | ○ |

TABLE 4-3

| SAMPLE No. | UNDERCOAT PLATING LAYER TYPE | UNDERCOAT PLATING LAYER THICKNESS (μm) | MAIN PLATING LAYER TYPE | MAIN PLATING LAYER THICKNESS (μm) | DRY COATING WEIGHT OF PFPE-CONTAINING COATING ($mg/cm^2$) | ANTI-CORROSION TREATMENT | EVALUATION |
|---|---|---|---|---|---|---|---|
| 39 | Ni | 2.5 | Au | 0.4 | 0.005 | N/A | X |
| 40 | Ni | 2.5 | Au | 0.2 | 0.005 | N/A | X |
| 41 | Ni | 2.5 | Au | 0.2 | 0.011 | N/A | X |
| 42 | Ni | 2.5 | Au | 0.2 | 0.019 | N/A | X |
| 43 | Ni | 2.5 | Au | 0.2 | 0.032 | N/A | X |
| 44 | Ni | 2.5 | Au | 0.1 | 0.005 | N/A | X |
| 45 | Ni | 2.5 | Au | 0.1 | 0.011 | N/A | X |
| 46 | Ni | 2.5 | Au | 0.1 | 0.019 | N/A | X |
| 47 | Ni | 2.5 | Au | 0.1 | 0.032 | N/A | X |
| 48 | Ni | 2.5 | Au | 0.1 | 0.04 | N/A | Δ |
| 49 | Ni | 2.5 | Au | 0.05 | 0.005 | N/A | X |
| 50 | Ni | 2.5 | Au | 0.05 | 0.011 | N/A | X |
| 51 | Ni | 2.5 | Au | 0.05 | 0.19 | N/A | X |
| 52 | Ni | 2.5 | Au | 0.05 | 0.032 | N/A | X |
| 53 | Ni | 2.5 | Au | 0.05 | 0.04 | N/A | X |
| 54 | Ni | 2.5 | Au | 0.05 | 0.07 | N/A | X |
| 55 | Ni | 2.5 | Au | 0.05 | 0.11 | N/A | X |
| 56 | Ni | 2.5 | Au | 0.05 | 0.18 | N/A | Δ |

TABLE 4-4

| SAMPLE No. | UNDERCOAT PLATING LAYER TYPE | UNDERCOAT PLATING LAYER THICKNESS (μm) | MAIN PLATING LAYER TYPE | MAIN PLATING LAYER THICKNESS (μm) | DRY COATING WEIGHT OF PFPE-CONTAINING COATING ($mg/cm^2$) | ANTI-CORROSTION TREATMENT | EVALUATION |
|---|---|---|---|---|---|---|---|
| 57 | Ni | 2.5 | Au | 0.03 | 0.005 | N/A | X |
| 58 | Ni | 2.5 | Au | 0.03 | 0.011 | N/A | X |
| 59 | Ni | 2.5 | Au | 0.03 | 0.019 | N/A | X |
| 60 | Ni | 2.5 | Au | 0.03 | 0.032 | N/A | X |
| 61 | Ni | 2.5 | Au | 0.03 | 0.04 | N/A | X |
| 62 | Ni | 2.5 | Au | 0.03 | 0.07 | N/A | X |
| 63 | Ni | 2.5 | Au | 0.03 | 0.11 | N/A | X |
| 64 | Ni | 2.5 | Au | 0.03 | 0.18 | N/A | X |

TABLE 4-4-continued

| SAMPLE No. | UNDERCOAT PLATING LAYER TYPE | UNDERCOAT PLATING LAYER THICKNESS (μm) | MAIN PLATING LAYER TYPE | MAIN PLATING LAYER THICKNESS (μm) | DRY COATING WEIGHT OF PFPE-CONTAINING COATING ($mg/cm^2$) | ANTI-CORROSTION TREATMENT | EVALUATION |
|---|---|---|---|---|---|---|---|
| 65 | Ni | 2.5 | Au | 0.01 | 0.005 | N/A | X |
| 66 | Ni | 2.5 | Au | 0.01 | 0.011 | N/A | X |
| 67 | Ni | 2.5 | Au | 0.01 | 0.019 | N/A | X |
| 68 | Ni | 2.5 | Au | 0.01 | 0.032 | N/A | X |
| 69 | Ni | 2.5 | Au | 0.01 | 0.04 | N/A | X |
| 70 | Ni | 2.5 | Au | 0.01 | 0.07 | N/A | X |
| 71 | Ni | 2.5 | Au | 0.01 | 0.11 | N/A | X |
| 72 | Ni | 2.5 | Au | 0.01 | 0.18 | N/A | X |
| 73 | Ni | 2.5 | Au | 0.8 | N/A | BENZOTHIAZOL | X |
| 74 | Ni—P | 2.5 | Au | 0.8 | N/A | BENZOTHIAZOL | X |
| 75 | Ni | 2.5 | Au | 0.8 | N/A | THIOL | X |

Table 5 shows the above evaluation results that are summarized based on the relationship between the thickness of the main plating layer and the dry coating weight of the PFPE-containing coating.

From these results, it was verified that both the reduced thickness of the main plating layer and the corrosion resistance are achieved simultaneously by applying the present invention.

TABLE 5

| THICKNESS OF MAIN PLATING LAYER (μm) | DRY COATING WEIGHT OF PFPE-CONTAINING COATING ($mg/cm^2$) 0.005 | 0.011 | 0.019 | 0.032 | 0.04 | 0.07 | 0.11 | 0.18 | 0.25 | 0.37 | 0.43 |
|---|---|---|---|---|---|---|---|---|---|---|---|
| 0.01 | X (SAMPLE 65) | X (SAMPLE 66) | X (SAMPLE 67) | X (SAMPLE 68) | X (SAMPLE 69) | X (SAMPLE 70) | X (SAMPLE 71) | X (SAMPLE 72) | ○ (SAMPLE 30) | ○ (SAMPLE 31) | ○ (SAMPLE 32) |
| 0.03 | X (SAMPLE 57) | X (SAMPLE 58) | X (SAMPLE 59) | X (SAMPLE 60) | X (SAMPLE 61) | X (SAMPLE 62) | X (SAMPLE 63) | X (SAMPLE 64) | ○ (SAMPLE 27) | ○ (SAMPLE 28) | ○ (SAMPLE 29) |
| 0.05 | X (SAMPLE 49) | X (SAMPLE 50) | X (SAMPLE 51) | X (SAMPLE 52) | X (SAMPLE 53) | X (SAMPLE 54) | X (SAMPLE 55) | Δ (SAMPLE 56) | ○ (SAMPLE 24) | ○ (SAMPLE 25) | ○ (SAMPLE 26) |
| 0.10 | X (SAMPLE 44) | X (SAMPLE 45) | X (SAMPLE 46) | X (SAMPLE 47) | Δ (SAMPLE 48) | ○ SAMPLE 18) | ○ (SAMPLE 19) | ○ (SAMPLE 20) | ○ (SAMPLE 21) | ○ (SAMPLE 22) | ◎ (SAMPLE 23) |
| 0.20 | X (SAMPLE 40) | X (SAMPLE 41) | X (SAMPLE 42) | X (SAMPLE 43) | ○ (SAMPLE 11) | ○ (SAMPLE 12) | ○ (SAMPLE 13) | ◎ (SAMPLE 14) | ◎ (SAMPLE 15) | ◎ (SAMPLE 16) | ◎ (SAMPLE 17) |
| 0.40 | X (SAMPLE 39) | ○ SAMPLE 1) | ◎ (SAMPLE 2) | ◎ (SAMPLE 3) | ◎ (SAMPLE 4) | ◎ (SAMPLE 5) | ◎ (SAMPLE 6) | ◎ (SAMPLE 7) | ◎ (SAMPLE 8) | ◎ (SAMPLE 9) | ◎ (SAMPLE 10) |

Further, photographic images of surfaces of the contacts of the connectors of samples 1 to 32 and samples 39 to 72 after the test are shown in FIG. 5. Further, photographic images the contacts of the connectors of samples 33 to 38 and samples 73 to 75 after the test are shown in FIG. 6.

As can be seen in Tables 4 and 5, it was verified that, with the dry coating weight of the PFPE-containing coating of greater than or equal to 0.011 $mg/cm^2$, good corrosion resistance can be obtained even if the thickness of the main plating layer was decreased to 0.4 μm. Also, it was verified that, with dry coating weight of the PFPE-containing coating of greater than or equal to 0.25 $mg/cm^2$, good corrosion resistance was obtained in a broader thickness region of the main plating layer.

On the other hand, as for the samples of comparative examples, as can be seen in Tables 4 and 5, it was verified that the contact resistance values did not meet the standard, and sufficient corrosion resistance was not obtained for severe corrosion resistance tests.

Second Example

Performance for tests other than the four-gas mixture resistant test by the present invention was examined and will be described below. Note that, for each of the following tests, a connector (sample 76) having a configuration the same as the configuration of the connector of sample 8 used in the first embodiment was used. That is to say, with the connector of sample 76, the thickness of the Au plating layer formed on the contact was 0.4 μm and the dry coating weight of the PFPE-containing coating was 0.25 $mg/cm^2$. Also, for each test, a surface condition of the contact before and after the test was observed and also contact resistance value was measured using a milli-ohm meter (manufactured by HIOKI: 3560 AC mΩ HiTESTER).

(Salt Spray Test)

A salt spray test complying with JIS H8502 was carried out with a sample being mated with a counterpart connector (receptacle connector) and under a condition of: temperature 35° C.; salt water concentration 5%; test duration 48 hours.

Figure 7A:
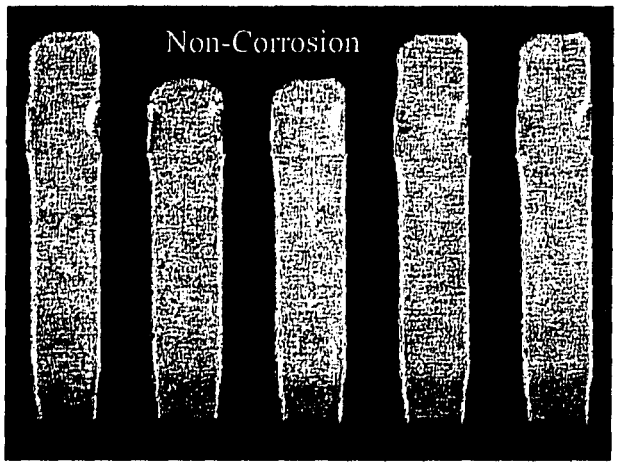
Figure 7B:
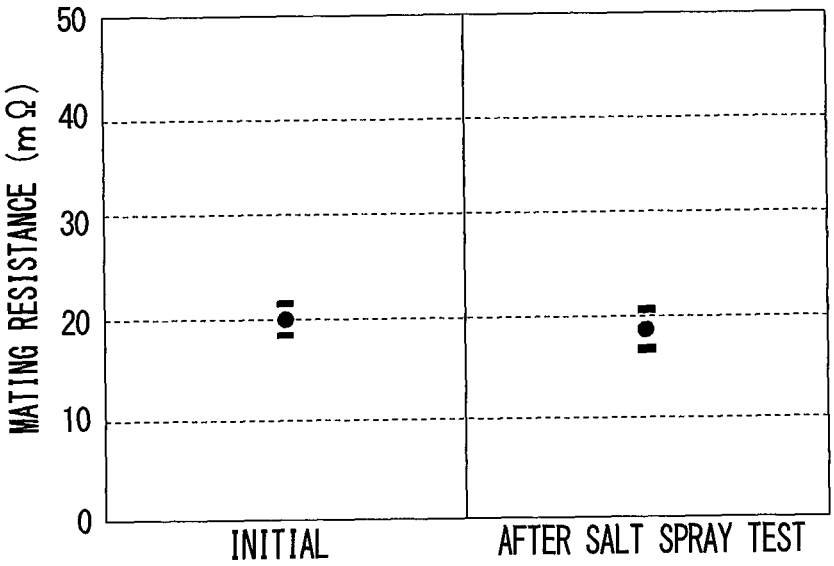

FIG. 7A shows an example of the surface condition observation result of the contacts after the salt spray test, and generation of a corrosion product due to the salt spray test was not clearly observed. FIG. 7B shows contact resistance values before and after the test, and it can be seen that there was almost no increase in contact resistance due to the salt spray test and it was within the standard (twice the initial contact resistance value or less). Therefore, it became clear that the connector to which the present invention was applied had a high corrosion resistance to the salt spray test.

(Two-Gas Mixture Test)

A two-gas mixture test was conducted by steps (a) to (e) below.

(a) Measurement of initial contact resistance value (measured by direct current four-probe method)

(b) 500 times of insertion and extraction (c) Measurement of contact resistance value (d) Exposure to two-gas mixture flow (96 hours, mated with a counterpart connector)

(e) Measurement of contact resistance value

Figure 8A:
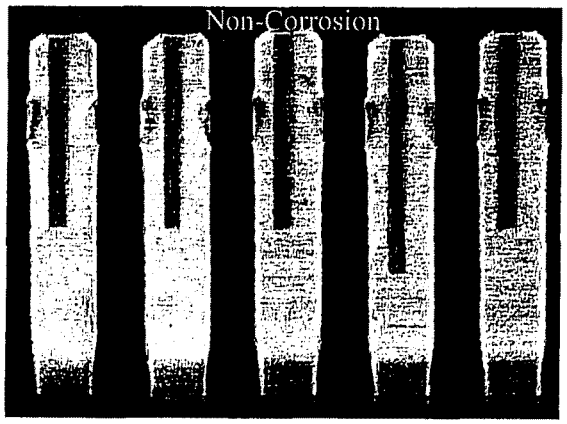
Figure 8B:
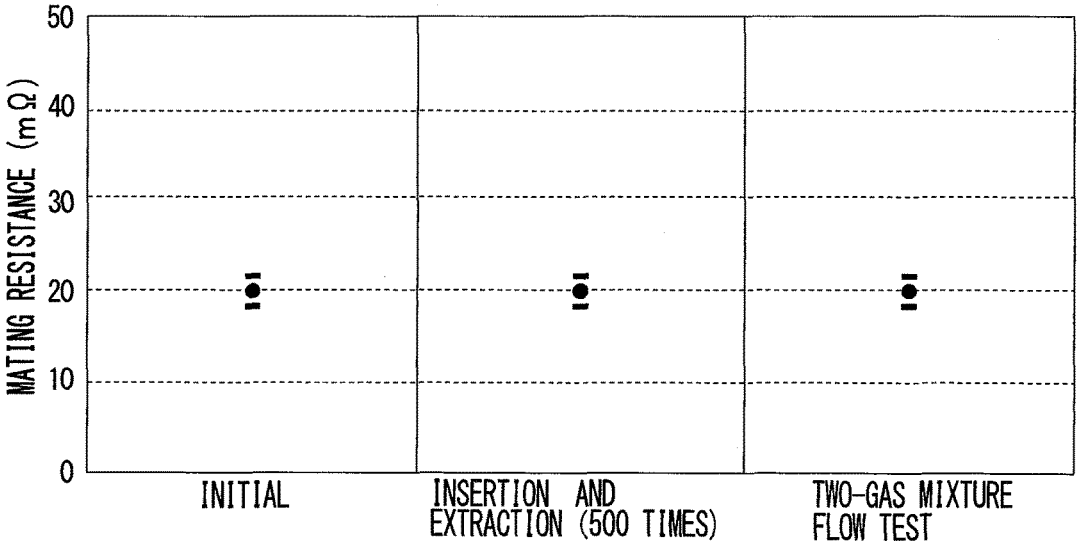

Note that, the two-gas mixture test satisfies conditions standardized among electronic equipment set manufacturers, and type and density of gases are: $H_2S$ 3 ppm; $SO_2$ 10 ppm; temperature of 40° C.; and humidity of 75% RH. FIG. 8A shows an exemplary surface condition observation result of contacts after the two-gas mixture test, and although the two-gas mixture test is partially an atmosphere that was more severe than a three-gas mixture test and a four-gas mixture test (gas concentration of an order of a few to several ppm, and 500 times of insertion and extraction), a corrosion product was not clearly produced. Also, FIG. 8B shows contact resistance values for before the test, after 500 times of insertion and extraction, and after the exposure to the two-gas mixture flow, but there was almost no increase in the contact resistance, and it was within the standard (twice the initial contact resistance value or less). Therefore, it became clear that the connector to which the present invention is applied also had a high corrosion resistance to the two-gas mixture test.

(Nitric Acid Vapor Test)

Figure 9:
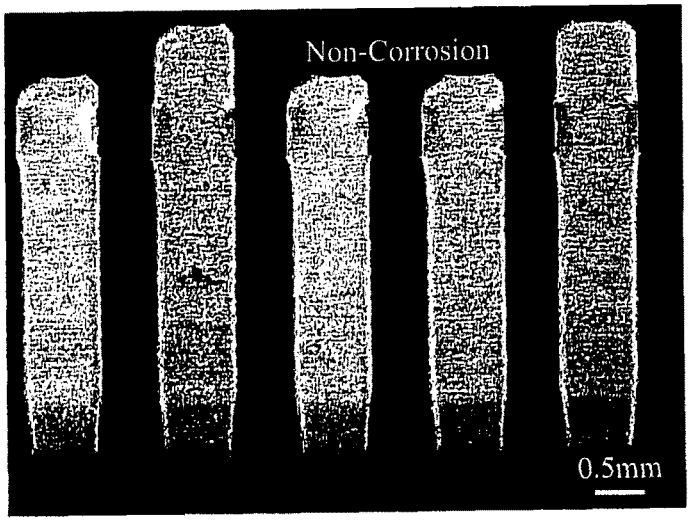
FIG. 9 is a photographic image showing a part of the surface condition observation result of the contacts after a nitric acid vapor test.
Figure 10:
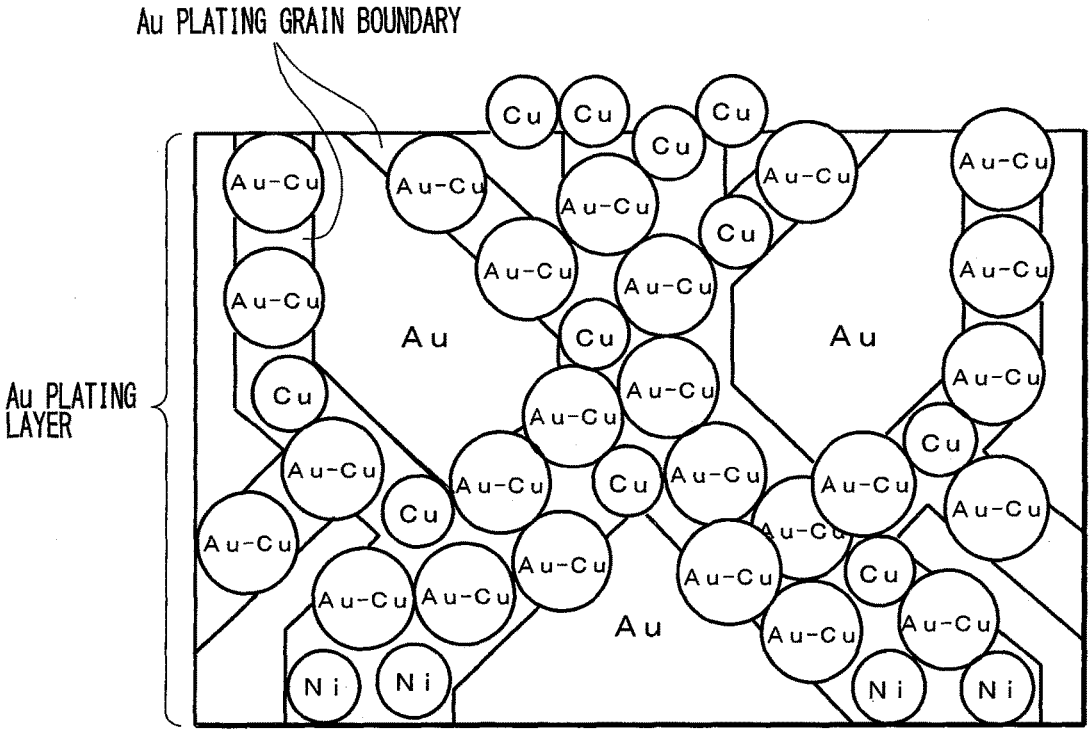
FIG. 10 is a schematic diagram showing a first step of a corrosion occurrence mechanism in the three-gas mixture test.
Figure 11:
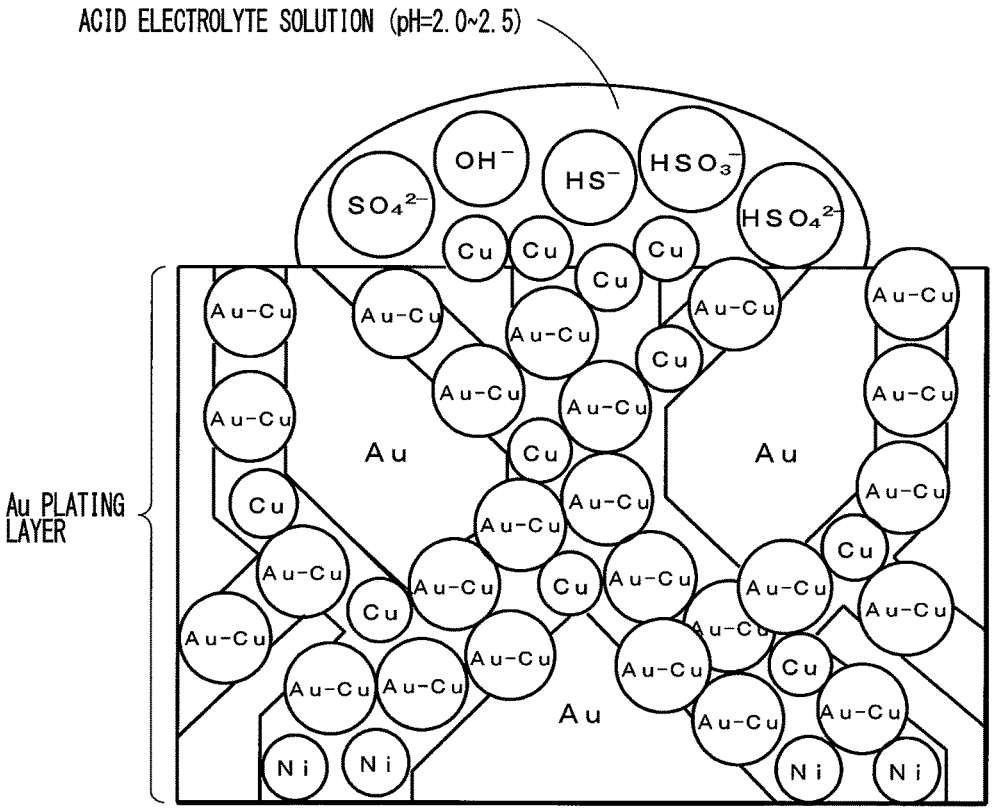
FIG. 11 is a schematic diagram showing a second step of a corrosion occurrence mechanism in the three-gas mixture test.
Figure 12:
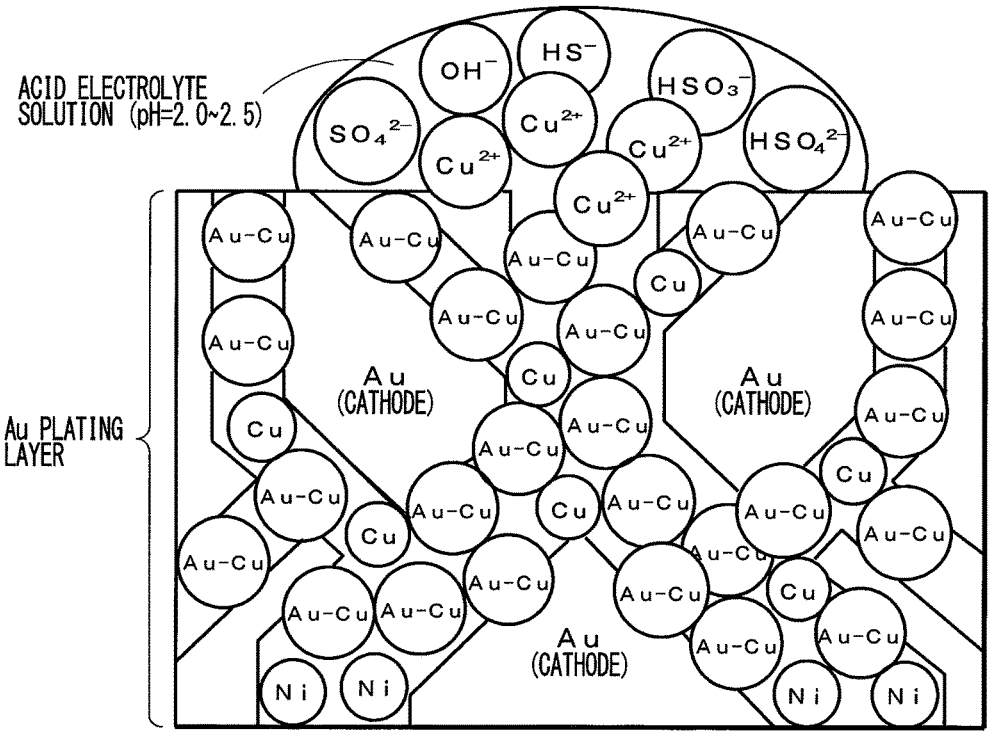
FIG. 12 is a schematic diagram showing a third step of the corrosion occurrence mechanism in the three-gas mixture test.
Figure 13:
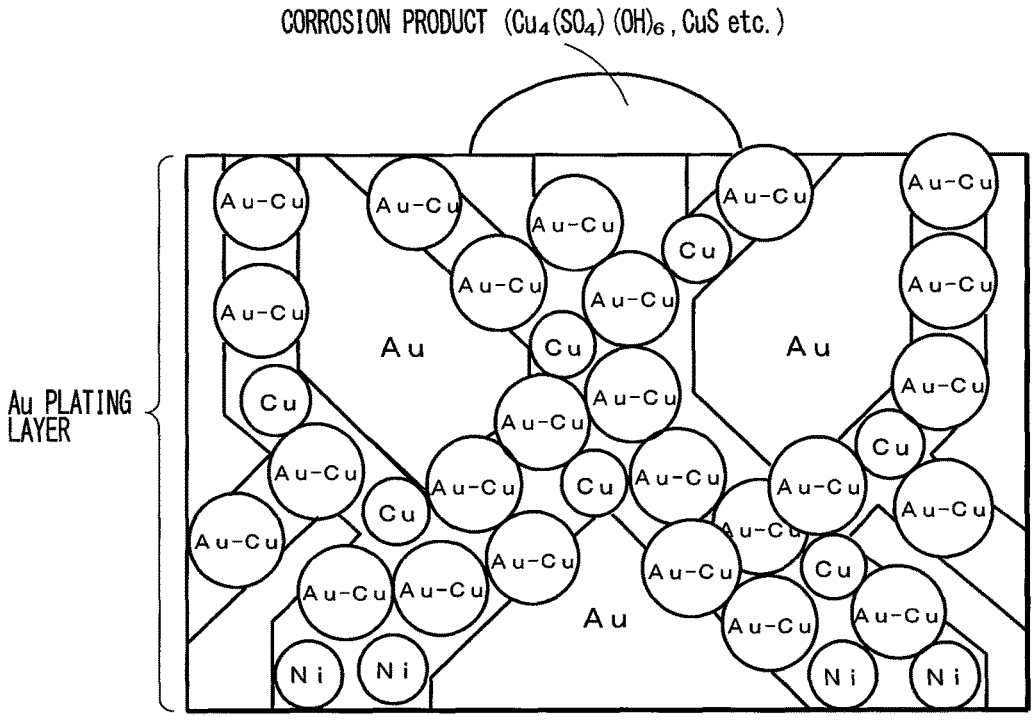
FIG. 13 is a schematic diagram showing a fourth step of the corrosion occurrence mechanism in the three-gas mixture test.
Figure 14:
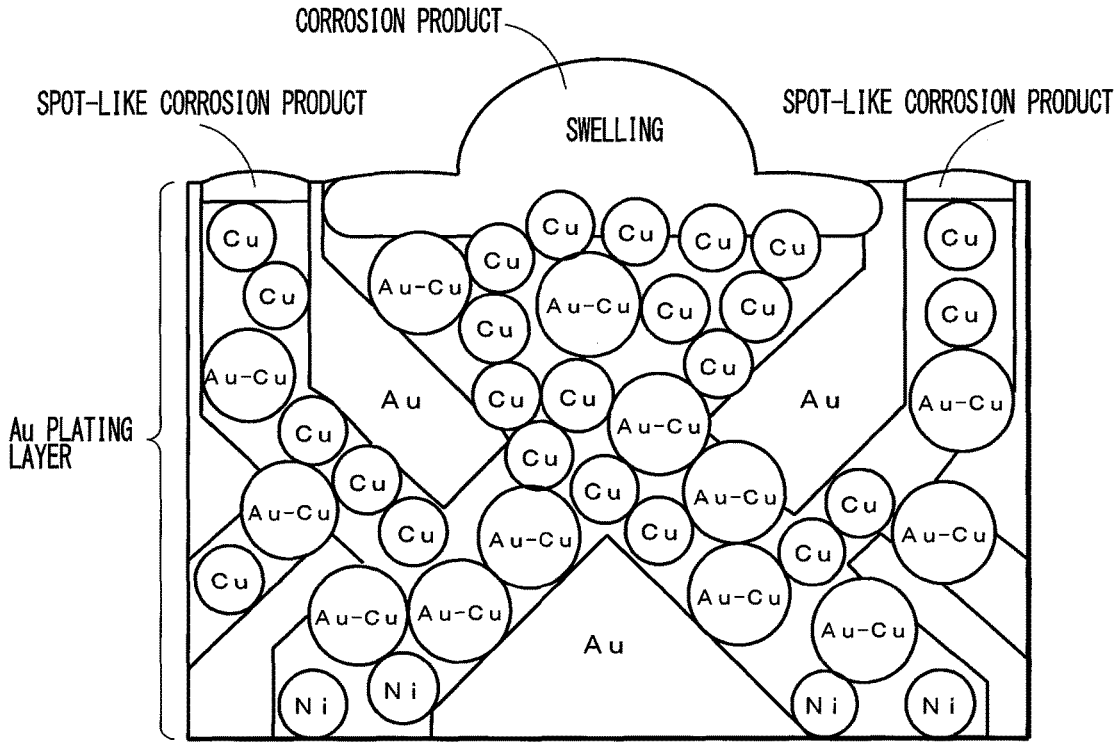
FIG. 14 is a schematic diagram showing a fifth step of the corrosion occurrence mechanism in the three-gas mixture test.
Figure 15:
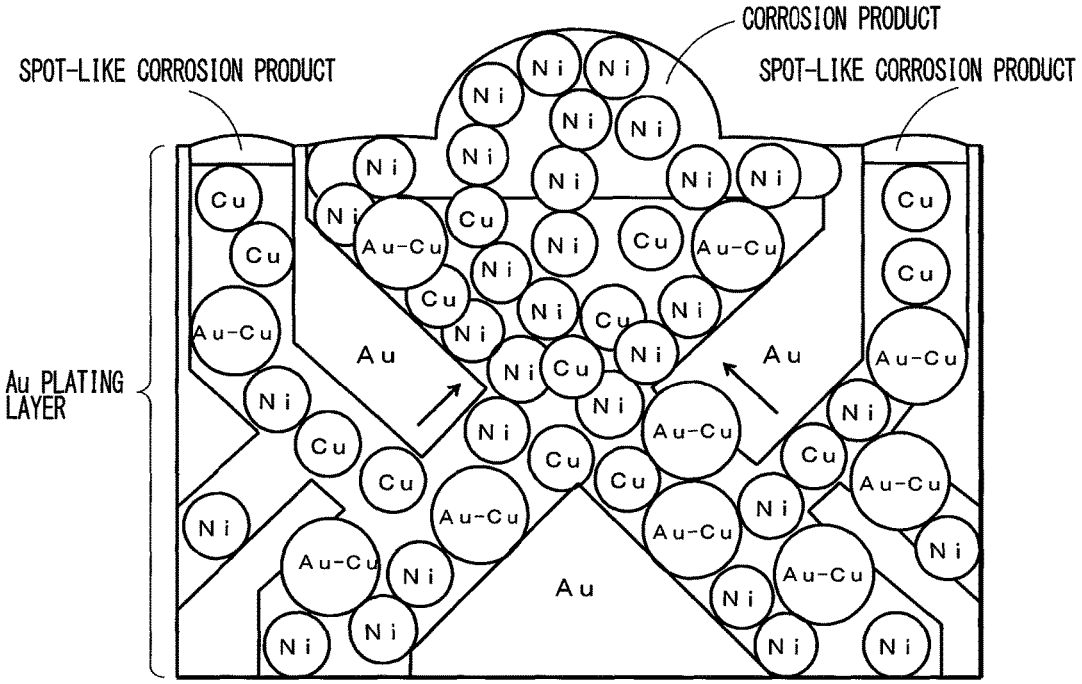
FIG. 15 is a schematic diagram showing a sixth step of the corrosion occurrence mechanism in the three-gas mixture test.
Figure 16:
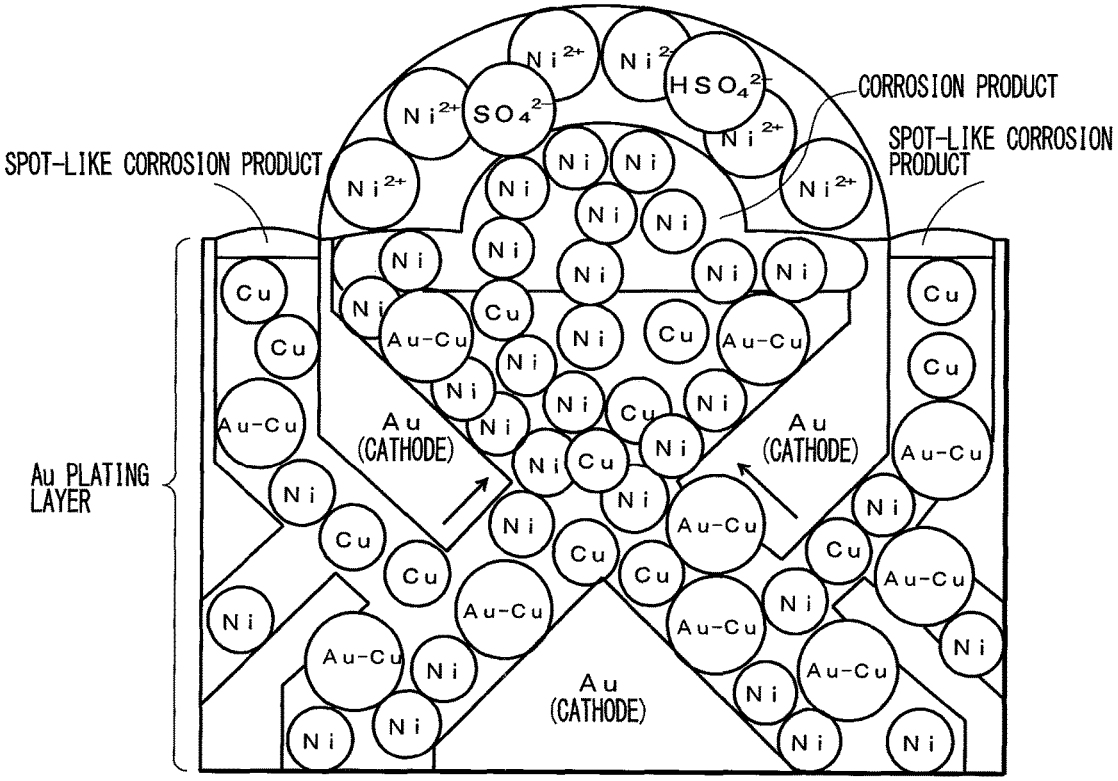
FIG. 16 is a schematic diagram showing a seventh step of the corrosion occurrence mechanism in the three-gas mixture test.
Figure 17:
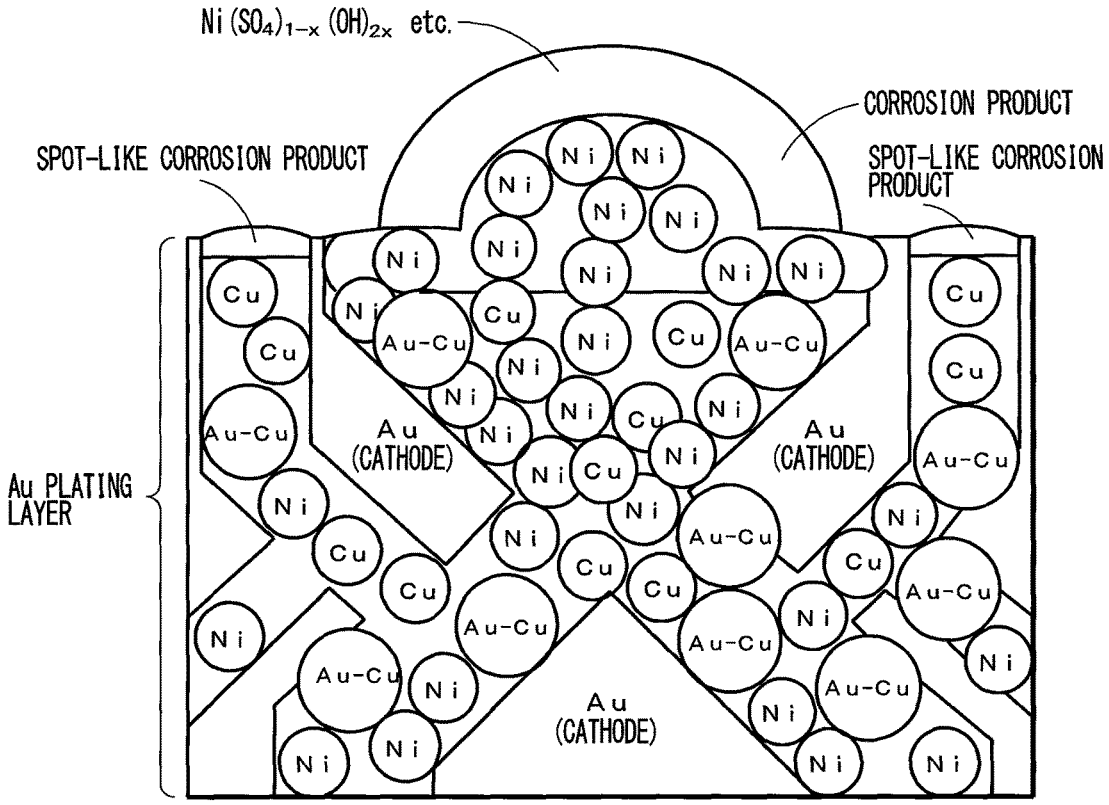
FIG. 17 is a schematic diagram showing an eighth step of the corrosion occurrence mechanism in the three-gas mixture test.
Figure 18:
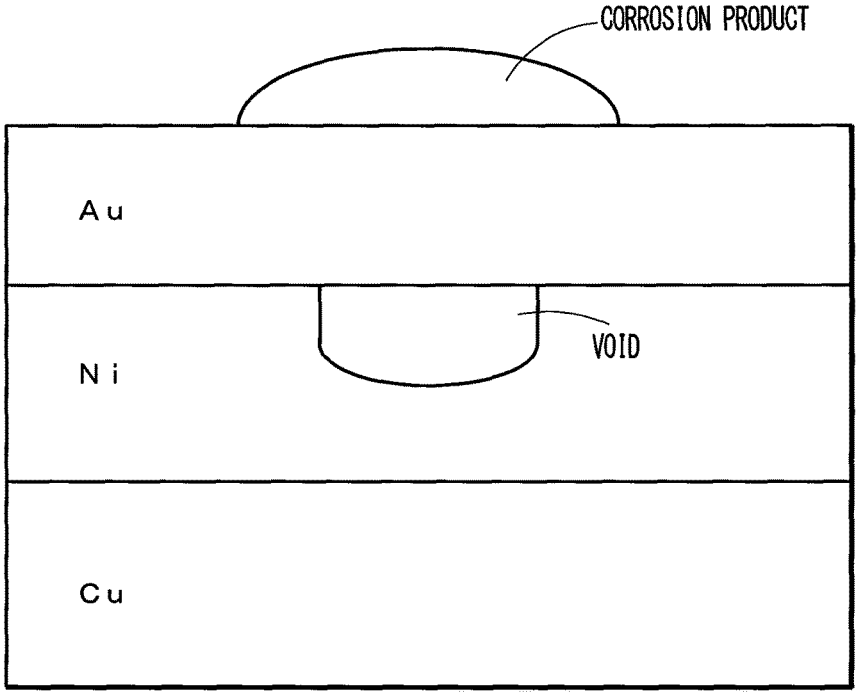
FIG. 18 is a schematic diagram showing how a void is formed in a Ni plating layer as a result of the three-gas mixture test.

A nitric acid vapor test complying with an EIA standard (EIA-364-53B) is carried out unmated with a counterpart connector and under a condition of: temperature 23° C.; nitric acid 300 ml (specific gravity 1.42); desiccator volume 6 L; and test duration of 75 minutes. Note that, for a nitric acid vapor test, there is no standard for measurement of a contact resistance value and thus only surface observation was performed. A method of counting corrosion products is as shown in Table 6 below. For example, in a case where the size of the corrosion product is 0.05 mm or smaller, the corrosion product is counted as zero. FIG. 9 shows a result of the surface evaluation, and it was clear that no corrosion products were produced in the nitric acid vapor test, and, the count was less than or equal to 1. Therefore, it became clear that the connector to which the present invention is applied had a high corrosion resistance to the nitric acid vapor test.

TABLE 6

| SIZE OF CORROSION PRODUCT (DIAMETER) | ALLOTTED COUNT | EVALUATION CRITERIA |
|---|---|---|
| ≤0.05 mm | 0 | PASS |
| >0.05 mm, <0.51 mm | 1 | |
| ≥0.51 mm | 2 | FAIL |
| REGARDLESS OF SIZE. CORROSION OCCURS IN A RANGE EXCEEDING 50% OF THE MEASURING REGION | 20 | |

From the above-mentioned test result, it was verified that the electronic components to which the present invention is applied have performance that can meet to all existing corrosion resistance tests and standards.

At last, various techniques for verifying the PFPE oil-based lubricating oil applied on the surface of the plated metal by an analysis will be described. An example thereof is shown below. Basically, since it is a method of detecting C (carbon), F (fluorine) and O (oxygen) constituting a PFPE oil to identify a substance, a perfect identification (substance identification) is difficult except for some techniques. However, if specific F (fluorine) is detected at an electrical contact position, it can be determined that at least a fluorine-based compound is applied. Also, substance identification is possible by analysis methods described below or by combinations with other methods.

(1) A Case in which PFPE Concentration is Greater than or Equal to 0.5 wt %

(i) Surface Analysis by EPMA (Electron Beam Micro Analyzer)

Since PFPE oil is composed primarily of C (carbon) and F (fluorine), these elements are surely detected by using an electron beam micro analyzer. Other than this, although the resolution is lower, detection is possible by EDX (energy dispersed type).

(ii) Surface Analysis by FT/IR (Fourier Transformation Infrared Spectrophotometer)

Since the PFPE oil is composed primarily of C (carbon), F (fluorine) and O (oxygen), and it is a polymeric compound having a "—$CF_2$—O—" skeleton, infrared absorption peaks originating from bonds between them appear. That is, an absorption peak of a high intensity will appear at 1300 to 1000 $cm^{-1}$ for a fluorine-based compound. Also, the PFPE oil includes an ether linkage (C—O—C), and thus an absorption peak originating from this also appears (it does not appear for polytetrafluoroethylene or the like). In addition, in a case where a CH group is included, an absorption peak appears around 3000 to 2800 $cm^{-1}$ about.

(2) In a Case where PFPE Concentration is Less than 0.5 wt %

Surface Analysis by XPS (X-Ray Photoelectron Spectrometer

In a case where the PFPE oil has a low concentration, the build-up of the coating to a surface reduced and thus the film thickness of the PFPE oil becomes small, and the detection is difficult with the analysis method described in section (1) (this is because a background intensity becomes high). Therefore, for such an analysis of a thin-film state, XPS that can analyze a top surface layer (e.g., a few to several nm) is effective. Similarly to EPMA, basically, the detected elements are C (carbon), F (fluorine) and O (oxygen). However, the bonding energy (horizontal axis) with respect to a photoelectric peak of each elemental (vertical axis) shifts depending on the bonding state (chemical shift). For example, when paying attention to the peak of C, it can be determined whether the compound exists in a state where it contains a "C—F" or "C—H" bond. Other than this, an AES (Auger Electron Spectrometer) is also effective for an analysis of the top surface layer.

(3) Other Analytical Methods (i) GC/MS (Gas Chromatography/Mass Spectrometer)

(ii) TOF-SIMS (Time-of-Flight Secondary Ion Mass Spectrometer)

(iii) RBS (Rutherford Backscattering Spectroscopy)

(iv) LRS (Laser Raman Spectroscopy, Microscopic Laser Raman Spectroscopy)

(v) NMR (Nuclear Magnetic Resonance Analyzer)

INDUSTRIAL APPLICABILITY

Thus, according to the present invention, an electronic component showing an excellent corrosion resistance to the four-gas mixture flow with an inexpensive structure can be provided.

LIST OF REFERENCE SIGNS

10 connector (electronic component)
12 housing
14 contact (contact member)
141 contact portion
143 connecting portion
145 conductive substrate
147 undercoat plating layer
149 main plating layer
16 coating

The invention claimed is:

1. An electronic component comprising:

at least a contact member having, on a surface of a contact portion adapted to come into contact with another contact member, at least an undercoat plating layer and a gold-containing main plating layer formed on the undercoat plating layer, wherein the contact portion further has a coating containing a fluorine-based oil on the main plating layer, and a lower limit value of a dry coating weight per unit area of the coating, determined in relation to the thickness of the main plating layer, is:

0.011 $mg/cm^2$ when a thickness of the main plating layer is greater than or equal to 0.4 μm, 0.04 $mg/cm^2$ when a thickness of the main plating layer is greater than or equal to 0.2 μm and less than 0.4 μm, 0.07 $mg/cm^2$ when a thickness of the main plating layer is greater than or equal to 0.1 μm and less than 0.2 μm, and 0.25 $mg/cm^2$ when a thickness of the main plating layer is less than 0.1 μm.

2. The electronic component according to claim 1, wherein the undercoat plating layer is one of a Ni plating layer, a Ni—P plating layer, a Pd—Ni plating layer, and a composite plating layer of a Ni plating layer and a Pd—Ni plating layer.

3. The electronic component according to claim 1, wherein the fluorine-based oil is a perfluoropolyether oil (PFPE oil).

4. The electronic component according to claim 2, wherein the fluorine-based oil is a perfluoropolyether oil (PFPE oil).

* * * * *